United States Patent [19]

Elsbett et al.

[11] Patent Number: 4,854,276

[45] Date of Patent: Aug. 8, 1989

[54] INTERNAL COMBUSTION ENGINE WITH COMBINED COOLING AND LUBRICATING SYSTEM

[76] Inventors: Ludwig Elsbett; Günter Elsbett; Klaus Elsbett, all of Industriestrasse 14-16, D-8543 Hilpoltstein, Fed. Rep. of Germany

[21] Appl. No.: 118,186

[22] Filed: Nov. 6, 1987

[30] Foreign Application Priority Data

Nov. 11, 1986 [DE] Fed. Rep. of Germany ..... 3638437

[51] Int. Cl.[4] ..... F01M 1/00

[52] U.S. Cl. ..... 123/196 AB; 123/41.42; 184/104.2

[58] Field of Search ..... 123/41.42, 41.31, 41.32, 123/196 AB, 198 C; 184/104.2

[56] References Cited

U.S. PATENT DOCUMENTS

| | | | |
|---|---|---|---|
| 4,248,293 | 2/1981 | Kamezaki | 123/196 AB |
| 4,284,037 | 8/1981 | Kasting et al. | 123/41.31 |
| 4,393,824 | 7/1983 | Fischer et al. | 123/196 AB |
| 4,397,269 | 8/1983 | Hatz | 123/196 AB |
| 4,436,067 | 3/1984 | Fritzenwenger | 123/198 C |
| 4,449,487 | 5/1984 | Krüger | 123/41.42 |
| 4,538,565 | 9/1985 | Hidaka et al. | 123/196 R |
| 4,541,368 | 9/1985 | Castarède | 123/196 AB |
| 4,703,726 | 11/1987 | Sekiya et al. | 123/196 AB |
| 4,708,095 | 11/1987 | Luterek | 123/41.42 |

*Primary Examiner*—E. Rollins Cross

*Attorney, Agent, or Firm*—Peter K. Kontler

[57] ABSTRACT

A diesel engine wherein the interior of the cylinder or cylinders, the piston or pistons, the crankshaft, the connecting rod or rods and the valves are lubricated and cooled by a first flow of lubricant which is circulated from the back to the sump by a first pump of a tandem pump. The second pump serves to circulate lubricant which serves to externally cool the cylinder or cylinders and the head as well as to heat the cabin or compartment in a motor vehicle.

22 Claims, 1 Drawing Sheet

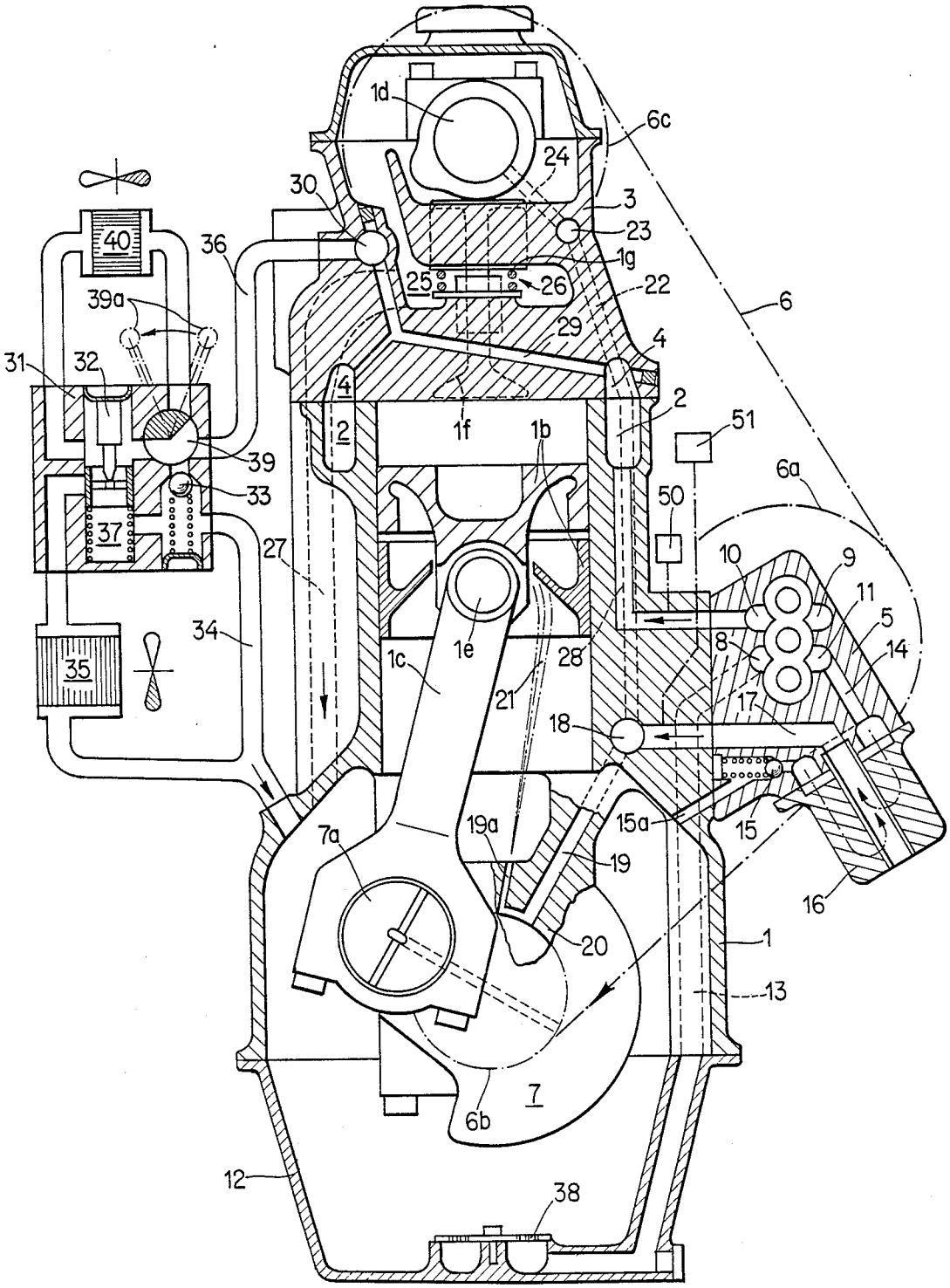
1d
6c
24
30
3
23
36
40
1g
25
26
22
39a
6
29
4
31
32
4
2
2
51
1f
1b
39
33
6a
50
37
27
10
9
11
5
34
8
14
35
1c
1e
28
21
17
18
7a
19a
15a
15
19
16
20
1
13
7
6b
12
38

INTERNAL COMBUSTION ENGINE WITH COMBINED COOLING AND LUBRICATING SYSTEM

BACKGROUND OF THE INVENTION

The invention relates to improvements in liquid-cooled engines, and more particuarly to improvements in internal combustion engines of the type wherein lubricant also serves as a medium for cooling various component parts of the engine.

German Offenlegungsschrift No. 35 09 095 discloses an engine wherein the lubricating circuit branches off the cooling circuit. This publication proposes to maintain the temperature of lubricant at a high level. German Pat. No. 648,930 discloses discrete lubricating and cooling circuits as well as discrete sources of lubricant and cooling medium. The patent also proposes to maintain the temperature of coolant at a high level.

German Pat. No. 658,055 and German Offenlegungsschrift No. 26 49 562 disclose engines wherein the cooling circuit branches off the lubricating circuit, i.e., there is a single path for the flow of lubricant from the source to the locus of diversion of some lubricant from the main stream of lubricant for the purpose of cooling. These publications further propose the utilization of a relief valve in order to maintain the "lubricating" lubricant at a pressure deviating from the pressure of lubricant which is to be used as a cooling medium. Thus, save for the engine of German Pat. No. 648,930, all of the above-enumerated publications propose a common source of lubricant, a first path for the circulation of lubricant for the purposes of lubrication, and a second path for the circulation of lubricant for the purposes of cooling whereby the two paths include a relatively long or very long common portion.

Numerous additional prior proposals deal with the mode of returning lubricant to the sump of an internal combustion engine. For example, the aforementioned German Offenlegungsschrift No. 26 49 562 and British Pat. No. 194,907 propose to control the flow of coolant (normally oil) with a pressure relief valve so that the coolant can flow through a heat exchanger or through a bypass and directly into the sump. The aforementioned German Offenlegungsschrift No. 35 09 095 proposes to employ a thermostatically controlled valve which regulates the return flow of coolant, either by way of a heat exchanger or directly through a bypass. This publication further proposes the provision of a second heat exchanger which can be used as a means for heating the driver's cabin or the passenger compartment of a motor vehicle and which can receive returning coolant ahead of or by way of the thermostatically controlled valve.

OBJECTS AND SUMMARY OF THE INVENTION

An object of the invention is to provide an engine, such as a diesel engine, with a novel combined cooling and lubricating system which is simpler, less expensive and more reliable than heretofore known systems.

Another object of the invention is to provide an engine wherein the stationary and mobile components are lubricated and cooled in a novel and improved way.

A further object of the invention is to provide a combined cooling and lubricating system which is more versatile than heretofore known systems and which can perform each of its two functions in an optimum way.

An additional object of the invention is to provide a novel and improved method of lubricating and cooling an internal combustion engine, such as a spontaneous-combustion engine.

Still another object of the invention is to provide a combined cooling and lubricating system which can perform one or more additional useful and desirable functions, such as cooling and lubricating parts which necessitate independent cooling and/or lubrication in conventional engines and/or heating the driver's cabin and/or the passenger compartment if the engine is installed in a motor vehicle.

A further object of the invention is to provide novel and improved means for circulating lubricant and cooling medium in an internal combustion engine and novel and improved means for determining the direction or directions of flow of lubricant and cooling medium and the pressure of such media in their respective paths.

Another object of the invention is to provide a novel and improved housing for use in the above outlined engine.

The invention is embodied in an internal combustion engine, such as a diesel engine, which includes a housing having at least one cylinder, a sump or another suitable source of lubricant in or at the housing, and a plurality of mobile components in the housing. Such components include a piston in each cylinder, at least one valve for each cylinder and piston unit to admit air into the combustion chamber and/or to evacuate combustion products from the combustion chamber, a crankshaft and a connecting rod connecting each piston with the crankshaft. The engine further comprises first conduit means defining a first elongated path for the flow of lubricant in the housing from and back to the source to lubricant and cool the mobile components, second conduit means defining a second path for the flow of lubricant in or at the housing from and back to the source to externally cool the cylinder and at least one mobile component (such as a portion of the piston and a portion at least of the valve or guide means for the valve), and means for circulating the lubricant along the first and second paths. In accordance with a presently preferred embodiment of the invention, the second path is or can be at least substantially sealed from the first path, and the circulating means comprises discrete first and second pumps which respectively serve to circulate lubricant along the first and second paths.

The engine preferably comprises means for operating the first and second pumps independently of each other, and the pumps can have means for circulating identical or similar quantities of lubricant per unit of time. For example, the circulating means can include a so-called tandem pump having a common inlet connected with the source of lubricant and discrete outlets (plenum chambers) each of which is arranged to deliver lubricant to a different conduit means.

Discrete means (such as pressure gauges, thermometers and/or other instruments) can be provided to monitor at least one variable parameter of lubricant in each of the conduit means. This renders it possible to monitor the flow of lubricant in each path independently of the other path and to ascertain the presence of irregularities at an early stage (for example, in an automatic way and with timely warning to the occupant or occupants of the vehicle in which the engine is installed).

The conduit means can be provided with means (such as flow restrictors) for maintaining the pressure of lubricant in the respective paths within predetermined ranges, particularly in such a way that the pressure in the first path is higher or much higher than the pressure in the second path. The arrangement can be such that, when the engine is warm and operates at nominal speed, the pressure of lubricant in the first path can be a multiple (such as 8 to 12 times) the pressure of lubricant in the second path. For example, the first conduit means can include one or more bores in the housing, and the housing part or parts defining such bore or bores acts or act as flow restrictor means to raise the pressure of lubricant to a desired level.

The first conduit means can include or consist of bores, channels and/or similar passages in one or more mobile components and/or in the housing, and the second conduit means can include at least one tubular member (such as a pipe or a hose) which is or can be located externally of the housing. At least one of the conduit means can comprise a bore which delivers lubricant from the source to the circulating means, e.g., a channel which delivers lubricant to the common inlet of a tandem pump. The casing of each pump can be affixed directly to the housing of the engine, i.e., there is no need to provide one or more conduits for delivery of lubricant from the housing to the casing of the pump or pumps and/or one or more conduits for delivery of pressurized lubricant from the casing of the pump to the housing of the engine.

The circulating means can include filter means for lubricant in at least one of the paths and pressure relief valve means in at least one of the conduit means. The filter means is preferably installed in the first path, and the first conduit means can include means (e.g., one or more nozzles) for spraying lubricant against at least one of the mobile components, particularly for directing one or more sprays of lubricant against the piston and against the interior of the cylinder. The arrangement may be such that the spraying means sprays 40–60% of lubricant which is circulated along the first path.

The engine further comprises guide means for the valve, and such guide means preferably consists (at least in part) of a material which exhibits satisfactory or highly satisfactory heat-conducting properties. The first path has a portion which is adjacent the guide means so that the lubricant which is circulated along the first path exchanges heat with the guide means. The guide means can include at least one large-diameter annular washer-like retainer for the valve spring.

Heat exchanger means can be installed in at least one of the paths to withdraw heat from lubricant before the lubricant reenters the source.

The engine can further comprise means for regulating the flow of lubricant in at least one of the first and second paths; such regulating means can include a thermostatically controlled valve, a pressure relief valve and a distributor valve. The regulating means can define three discrete sections of the one path, and each such section is or can be controlled to prevent or permit the flow of lubricant toward the source. The three sections can be opened or sealed simultaneously, sequentially or in any desired or necessary random sequence. For example, the flow of lubricant in the first section can be regulated by a valve, the flow of lubricant in the second section can be regulated in such a way that it flows through an atmospheric heat exchanger which withdraws heat from lubricant prior to reentry into the source, and the third section can lead through a heater in the driver's or passenger compartment or cabin of a motor vehicle if the engine is used to drive a motor vehicle.

The novel features which are considered as characteristic of the invention are set forth in particular in the appended claims. The improved engine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a sectional view of an internal combustion engine which embodies the invention, with certain parts shown schematically and with certain parts partly broken away.

DESCRIPTION OF THE PREFERRED EMBODIMENTS

The internal combustion engine which is shown in the drawing is a diesel engine having a housing 1 including one or more cylinders 1*a* for pistons 1*b*. Each piston 1*b* is connected with the crankshaft 7 in the housing 1 by a connecting rod 1*c*. The illustrated cylinder 1*a* is cooled internally and the topmost portion of the cylinder barrel (adjacent the head 3) is cooled externally by lubricant which is circulated through a jacket having an annular compartment 2 in communication with an annular compartment 4 in the adjacent portion of the head 3. The compartment 2 receives and conveys lubricant serving to cool that portion of the cylinder 1*a* which cannot be cooled from the inside in view of the presence of the piston 1*b*. The engine comprises two systems of conduits which define two at least substantially separate paths for the flow of lubricant which is drawn from a source 12 in the form of a sump at the bottom end of the housing 1. One system of conduits preferably consists exclusively of bores, holes, channels, compartments and like cavities in the housing 1, and the other system of conduits includes or can also include cavities as well as one or more tubular members in the form of pipes or hoses.

The means for circulating lubricant along the two paths includes two discrete gear pumps which together form a tandem pump 5 having a casing which is directly bolted or otherwise sealingly secured to the housing 1, i.e., without the interposition of pipes or hoses for conveying lubricant from the sump 12 into the tandem pump and for conveying pressurized lubricant from the tandem pump back into the housing 1. The means for driving the input element or elements of the tandem pump 5 includes an endless toothed belt 6 (indicated by phantom lines) which is trained over a toothed pulley 6*a* for the input element or elements of the pump 5, over a toothed driver pulley 6*b* on the crankshaft 7, and over a toothed pulley 6*c* on the camshaft 1*d* of the engine. The tandem pump 5 has two suction chambers 8, 9 and two plenum chambers 10, 11. Lubricant which is drawn from the sump 12 flows through a coarse filter 38 and thereupon through a tubular member 13 which can form an integral part of the housing 1 or is affixed to the exterior of the housing and delivers lubricant to the common inlet of the fluid flow machines which together form the tandem pump 5. The common inlet communicates with or includes the suction chambers 8 and 9.

The first path is defined by a system of conduits which includes a bore 14 machined into the casing of the pump 5 and serving to admit pressurized lubricant from the plenum chamber 11 into an oil filter 16 whence the lubricant flow into a bore 17 provided partly in the pump casing and partly in the housing 1. A pressure relief valve in the form of a check valve 15 is installed in a bypass 15*a* which connects the bore 17 with the sump 12 so that lubricant can reenter the sump even before it enters that portion of the first path which is defined by the housing 1 if the just mentioned portion of the first path is clogged. The system of conduits which define the first path further includes an elongated channel 18 which is machined into or is otherwise formed in the housing 1 and serves to distribute lubricant to several consumers. Thus, the channel 18 communicates with a bore 19 which conveys lubricant to the bearing 20 for the crankshaft 7 as well as to the bearing and cup on the crankpin 7*a* for the connecting rod 1*c*. Still further, the bore 19 admits lubricant into a nozzle 19*a* which directs at least one jet or spray 21 of lubricant against the two sections of the composite piston 1*b* as well as against the internal surface of the barrel of the cylinder 1*a*. Reference may be had to the commonly owned copending patent application Ser. No. 710,864 filed Mar. 12, 1985 by Ludwig, Günter and Klaus Elsbett for "Internal combustion engine with reduced oise and heat emission" which shows one presently preferred mode of withdrawing heat from the cylinder and piston of an internal combustion engine with sprays or jets of lubricant. The spray or sprays 21 of lubricant further serve to lubricate and cool the piston pin 1*e* which connects the two sections of the piston 1*b* to each other and to the connecting rod 1*c*.

The channel 18 further supplies lubricant to a bore 22 which discharges into a channel 23 in the head 3. The channel 23 supplies lubricant to a bore 24 which, in turn, supplies lubricant to the bearings for the camshaft 1*d*. Lubricant which flows out of the bearings for the camshaft 1*d* is conveyed to and lubricates the valving elements of the valves 1*f* in the head 3 above the combustion chamber in the top face of the upper section of the piston 1*b*. Moreover, such lubricant cools the guide means 26 for the valving elements. The illustrated guide means 26 includes at least one large washer or ring which is made of a material exhibiting highly satisfactory heat conducting properties and such ring or rings can simultaneously serve as a retainer means for the valve spring 1*g*. The character 25 denotes a compartment which serves for collection of lubricant in the region of the guide means 26 and is configurated in such a way that lubricant which flows therein can contact and cool the entire guide means. A further bore 27 of the first system of conduits serves to return lubricant from the compartment 25 into the sump 12.

The second system of conduits receives pressurized lubricant from the plenum chamber 10 of the tandem pump 5, and such lubricant enters a bore 28 which is provided in the housing 1 and delivers lubricant to the annular compartments 2, 4 surrounding the upper portion of the cylinder barrel and further serving to circulate lubricant in the adjacent portion of the head 3. A bore 29 conveys lubricant from the compartments 2, 4 through the head 3 in the region between the valves including the valve 1*f* and to a collecting channel 30. A regulating unit 31 receives lubricant from the channel 30 by way of a tubular member 36 and contains a thermostatically controlled slide valve 37, a distributor valve 39 and a pressure relief valve 33. A bypass 34 in the form of a tubular member is provided to convey lubricant directly through the distributor valve 39 (which is actuatable by hand, e.g., by way of a lever 39*a* which is indicated (in two positions) by phantom lines) and the valve 37 back into the sump 12. The distributor valve 32 can direct the lubricant into any one of three sections of the second path, namely by way of the pressure relief valve 33, by way of a heat exchanger 40 (which can serve as a means for heating the driver's cabin or the passenger compartment of a motor vehicle) or (by way of the slide valve 37) into a second (atmospheric) heat exchanger 35 which withdraws heat from lubricant ahead of the sump 12. The thermostat 32 can respond when the temperature of returning lubricant reaches a predetermined value to compel the lubricant to return into the sump 12 by way of the atmospheric heat exchanger 35. The two streams of lubricant are intermixed in the sump 12 and the mixture is then drawn into the tubular member 13 by way of the coarse filer 38 when the engine is running.

The drawing shows the positions of elements in the regulating unit 31 when the lubricant is relatively cool. If the temperature of lubricant reaches a preselected value, the thermostat 32 expands and causes the slide valve 37 to seal the bypass 34 from the tubular member 36 and to simultaneously establish communication between the tubular member 36 and the heat exchanger 35 so that the lubricant is cooled prior to flowing back into the sump 12. If the pressure of lubricant in the regulating unit 31 rises above a preselected maximum permissible value, the relief valve 33 opens and establishes communication between the tubular member 36 and the bypass 34. Such situation can develop if the lubricant is cold so that it encounters a pronounced resistance to a flow through the heat exchanger 35. The pressure relief valve 33 can be designed in such a way that it permits a portion of the stream of lubricant in the tubular member 36 to flow into the bypass 34, and such flow via bypass 34 continues until the resistance to the flow of lubricant through the heat exchanger 35 decreases. If the lever 39*a* is actuated to move from the right-hand toward or all the way to the left-hand position, the distributor valve 39 permits some or all of the lubricant to flow from the tubular member 36 into and through the heating means 40. At such time, the thermostat 32 continues to monitor the temperature of lubricant and is ready to open the slide valve 37 (either entirely or in part) as soon as the need arises. The same holds true for the pressure relief valve 33 which is ready to open as soon as the lubricant encounters excessive resistance to flow through the heating means 40.

The drawing further shows discrete monitoring means 50 and 51 for the streams of lubricant in the two paths. Each of these monitoring means can include a pressure gauge and/or a thermometer which monitors the corresponding parameter of the stream of lubricant and can generate a visible and/or audible signal or can serve to automatically regulate the temperature and/or pressure of the circulating fluid if the corresponding parameter is unsatisfactory.

It will be seen that the liquid medium which is stored in the sump 12 performs a number of different functions, depending upon the locus of the respective portion of the first and/or second path. Thus, the medium serves as a lubricant for all or nearly all moving parts of the engine, the medium also serves to withdraw heat from certain component parts of the engine, the medium can dissipate heat to the atmosphere, and the medium can dissipate heat (at 40) in a region where the dissipated heat performs a useful function such as heating a cabin or a passenger compartment. The two streams of liquid medium merge in a sump 12 to form a mixture whose temperature matches or approximates a desired value, and the mixture is drawn via filter 38 to enter the joint inlet of the two pumps which together form the tandem pump 5. The characteristics of the two streams which are conveyed along the aforediscussed paths (from the plenum chamber 11 to the sump 12 via bore 27 and from the plenum chamber 10 via regulating unit 31 and back to the sump through the bypass 34 or through the atmospheric heat exchanger 35) are or can be determined and regulated to a considerable extent by appropriate selection, configuration and dimensioning of the two systems of conduits. This ensures that each and every component of the engine receives lubricant and/or coolant at an optimum pressure and/or temperature and/or rate. The utilization of a single liquid medium which serves as a coolant and as a lubricant is preferred at this time because this eliminates problems which could and normally do arise if the coolant (such as water) is not used for lubrication of moving parts.

It has been found that the establishment of two discrete paths for the flow of lubricant and coolant (i.e., for the flow of those streams of one and the same body of oil which are respectively used to lubricate and to cool various parts of the engine) brings about a number of important advantages, particularly as regards the quality of the lubricating and cooling actions, simplicity and low cost of the combined cooling and lubricating system, reliability of the cooling and lubricating actions, and the possibility of selecting the parameters of lubricant independently of the parameters of the cooling medium and vice versa. Thus, and with the possible (but not absolutely necessary) exception of the common portion of the two paths defined by the tubular member 13 which delivers liquid medium to the inlet or inlets of the tandem pump 5, the two paths are independent or discrete paths each of which can convey the liquid medium at the required rate, pressure and temperature and to the desired locations in or externally of the housing 1. As a rule, the pressure of lubricant in the respective path should be higher than the pressure of lubricant which is used as a cooling medium. Moreover, it is more important to prevent penetration of foreign particles (such as fragments of metal and other relatively hard materials which could damage or cause excessive wear upon various bearings) into the path for the flow of lubricant; therefore, the casing of the tandem pump 5 comprises the afore-discussed filter 16 through which the stream of pressurized lubricant issuing from the plenum chamber 11 must pass on its way into the distributor channel 18 of the first system of conduits. On the other hand, that flow of lubricant which is used as a cooling medium and is less likely to come in contact with sensitive bearings or like component parts need not be filtered at all or can be adequately filtered by a coarse filter (38). In spite of such advantages of the provision of discrete paths for lubricant and cooling medium, the utilization of a single lubricant source (sump 12) is preferred at this time because, if necessary, heat can be withdrawn from the entire body of confined lubricant in order to regulate the temperature of the driver's cabin or the passenger compartment (e.g., by the simple expedient of providing a sealable path between the bore 27 and tubular member 36).

While it is also possible to provide a high-quality filter for the cooling medium (e.g., in the bore 28) in addition to the filter 16, or to use a common filter for lubricant and cooling medium, it is presently preferred to use a high-quality filter only for the lubricant because the energy requirements of the tandem pump could be unduly increased if all of the liquid medium which is drawn from the sump 12 via tubular member 13 were to pass through the filter 16 or partly through the filter 16 and partly through an equivalent filter.

As mentioned above, German Offenlegungsschrift No. 26 49 562 discloses an engine wherein the medium which is used as a coolant can pass through a heat exchanger or directly through a bypass in order to reenter the source. This publication further discloses a system wherein a single stream of lubricant and coolant passes through a specially designed filtering arrangement to be thereupon divided into a stream of filtered lubricant and a discrete stream of unfiltered coolant.

The pressure relief valve 15 in the casing of the tamdem pump 5 serves to regulate the quantity of circulating lubricant in the first system of conduits as well as to determine the upper limit of pressure of lubricant which leaves the plenum chamber 11 and flows through the filter 16, bore 17 and along the remaining portion of the first path to reenter the sump 12 via bore 27. However, it has been found that all of the regulating functions should not be carried out by the valve 15 because this could adversely affect certain stages of operation, for example, when the valve 15 is open and the pressure of lubricant drops abruptly downstream of the filter 16 as a result of return flow of pressurized lubricant into the sump 12 upstream of the bore 17. Those fluctuations of pressure which develop as a result of opening of the valve 15 propagate themselves along the first path and can adversely affect the quality of the lubricating action. Moreover, such fluctuations of pressure entail fluctuations in the rate of flow of lubricant through the engine. This could be overcome only by repeated adjustments which are neither practical nor desirable in internal combustion engines.

Complete or nearly complete separation of the circuits for lubricant and coolant is desirable and advantageous on the additional ground that the pressure of lubricant is normally higher than the pressure of coolant. By providing two practically discrete paths, it is now possible to regulate the pressure of lubricant independently of the pressure of that lubricant which is used to cool certain parts of the engine and/or certain other units or compartments or cabins in the vehicle which embodies the engine. In the absence of separation of the two circuits in the region of the tandem pump 5, it would be necessary to first raise the pressure of the entire flow of lubricant including that stream which serves to lubricate and the stream which is used for cooling, and to thereupon lower the pressure of the cooling stream to a value which is best suited to perform a satisfactory cooling action.

Lubricant which is conveyed along the first path comes in contact with bearings and other parts which move along and tend to rub against the neighboring parts so that it is necessary to establish a film of lubricant between such parts. The lubricant further produces an internal cooling action, for example, upon the piston pin 1*e*, the internal surface of the cylinder barrel, the surfaces of the composite piston 1*b*, and others. The lubricant which is used exclusively or practically exclusively as coolant cools the topmost portion of the cylinder barrel (at 2), the adjacent portion of the head 3 (at 4) and the region of the valve or valves 1*f*, i.e., it cools parts which are not in frictional contact with moving parts or vice versa or to cool parts which are not in contact with moving parts in regions adjacent the second path.

Since the cooling action of a lubricant (normally oil) is less satisfactory than that of water or other conventional cooling media, it is desirable to embody the present invention in an engine whose operation is such that a larger quantity of heat is transmitted to the working medium and a lesser quantity of heat is transmitted to the material surrounding the combustion chamber. This renders it possible to avoid undue enlargement of the spaces for coolant and/or the need for auxiliary pumps in order to circulate larger quantities of oil as proposed in the aforementioned German Offenlegungsschrift No. 35 09 095 and in German Offenlegungsschrift No. 28 25 870.

The need for a pronounced cooling action can be avoided in an oil-cooled engine if the combustion of fuel takes place in accordance with a duothermal process which involves the establishment of a layer of cool air around the central zone of the combustion chamber, for example, in a manner as disclosed in German Pat. No. 22 41 355. Alternatively, or in addition to reliance upon a duothermal combustion technique, the improved engine can employ a piston whose material exhibits a relatively low heat conductivity to reduce the transfer of heat to the cylinder (reference may be had to commonly owned U.S. Pat. No. 4,593,660 granted June 10, 1986 to Ludwig and Günter Elsbett for "Piston drive for use in diesel engines or the like"). Such piston can include a first section which defines the combustion chamber and is made of cast iron, and a second portion which is articulately connected to the first section and can be made of aluminum or an aluminum alloy. The cooling action upon the cylinder and the piston of such an engine can be identical with or similar to that disclosed in German Pat. No. 25 43 478. This reduces the need for intensive external cooling. It suffices in such engines if the cooling action upon the cylinder is limited to the region immediately adjacent the head (note the compartment 2) and to the adjacent portion of the head (note the compartment 4). The coolant in the bore 28 also contributes to a desirable external cooling of the cylinder 1*a*.

Another advantage of the improved engine wherein the external cooling action (by the lubricant which is circulated along the second path from the plenum chamber 10 to the sump 12) need not be very pronounced is that the engine is warmed up and the lubricant is heated within a short interval of time. Therefore, it is not necessary to branch the path for lubricant off the path for coolant at a considerable distance downstream of the circulating means 5.

It has been found that the improved engine rapidly establishes an equilibrium between the cooling action of lubricant which is conveyed from the plenum chamber 11 to the sump 12 via bore 27 and the cooling action of lubricant which is conveyed from the plenum chamber to the sump 12 via bypass 34 and/or atmospheric heat exchanger 35. This renders it possible to employ a tandem pump which can circulate the lubricant for internal cooling and lubrication as well as lubricant for external cooling. The tandem pump can circulate two separate streams or flows of lubricant without undesirable mixing of such streams in the path portions downstream of the chambers 10, 11 and upstream of the sump 12.

The dissipation and/or utilization of heat which is contained in the stream of lubricant serving as a coolant also constitutes an important feature of the present invention. This will be readily appreciated by bearing in mind that the temperature of lubricant in the sump 12 should be maintained within a desired range and that it is often necessary to recover at least a certain percentage of heat which is contained in the coolant, e.g., to heat the cabin and/or compartment or compartments in a motor vehicle.

It has been found that the engine will operate quite satisfactorily if all of the lubricant which is drawn from the sump 12 via tubular member 13, or at least that stream of lubricant which is used to produce an external cooling action, is free to reenter the sump 12 along one or more of the following sections of the respective path:

(a) Directly by way of the tubular member 36, distributor valve 39 and bypass 34 (via pressure relief valve 33 and/or via slide valve 37). This is desirable when the engine is cold or when the engine is operated in a cold or very cold climate. At such time, the temperature of lubricant is so low that it need not be subjected to any cooling (such as in the heat exchanger 35) prior to reentering the sump 12. Moreover, and since it is always desirable to circulate a lubricant whose starting temperature is within a certain range of temperatures, such temperature can be reached much more rapidly if the lubricant which was used to bring about an external cooling action (namely the lubricant flowing from the plenum chamber 10 to the sump 12 via regulating unit 31) is permitted to flow back into the sump directly through the bypass 34 rather than flowing through the heat exchanger 35. As a rule, the stream of lubricant which is used for actual lubrication of moving parts and for internal cooling (as at 21 and elsewhere) is permitted or caused to return directly into the sump 12 so that it also contributes to rapid establishment of a temperature which is best suited for the body of lubricant in the sump.

(b) Partly through the bypass 34 and partly through the atmospheric heat exchanger 35 or solely by way of the heat exchanger 35. This ensures predictable and extensive cooling of the lubricant prior to reentry into the sump 12.

(c) By way of the heating means 40.

(d) Along two or more sections of the second path, e.g., partly by way of the heat exchanger 40 and partly by way of the heat exchanger 35. The distributor valve 39 is or can be designed in such a way that it allows for the flow of two or more smaller streams of lubricant which must reenter the sump 12, e.g., by way of both heat exchangers (35 and 40) and also by way of the bypass 34 at any one of a practically infinite number of different rates (from zero to 100%).

This not only ensures a satisfactory heating of a cabin or compartment but also that the temperature of lubricant which is stored in the sump 12 will invariably remain within the optimum range. The regulating unit 31 can be installed at any desired practical distance from the housing 1 of the engine.

As mentioned above, the engine can be provided with two independent pumps so that the rate of flow of lubricant along one of the paths can be altered independently of the rate of flow of lubricant along the other path. The arrangement may be such that the independent pumps or a tandem pump will circulate identical or nearly identical quantities of lubricant per unit of time.

The pressure of lubricant in each of the two paths can be regulated by appropriate selection of the housing portions and/or tubular members which define the two paths. Such portions can act as flow restrictors. Alternatively, suitable adjustable or fixed flow restrictors can be installed in certain bores, channels or other passages of the two systems of conduits. In fact, the filter 16 constitutes a flow restrictor which can be replaced with a different filter in order to alter the resistance to the flow of lubricant along the respective (first) path. The pressure in the first path can be a multiple of the pressure in the second path. For example, when the engine is warm and is operated at nominal speed, the pressure in the first path can be 8–12 times the pressure in the second path.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. An internal combustion engine comprising a housing including at least one cylinder; a source of lubricant in said housing; a plurality of mobile components in said housing including a piston in said cylinder, at least one valve, a crankshaft and a connecting rod between said crankshaft and said piston; first conduit means defining a first path for the flow of lubricant in said housing from and back to said source and for lubrication and cooling of said mobile components; second conduit means defining a second path for the flow of lubricant from and back to said source and for external cooling of said cylinder and at least one of said mobile components, said second path being at least substantially sealed from said first path; and means for circulating the lubricant along said paths, comprising discrete first and second pumps respectively arranged to circulate lubricant along said first and second paths.

2. The engine of claim 1, further comprising means for operating said pumps independently of each other.

3. The engine of claim 1, wherein said pumps have means for circulating similar or identical quantities of lubricant per unit of time.

4. An internal combustion engine comprising a housing including at least one cylinder; a source of lubricant in said housing; a plurality of mobile components in said housing including a piston in said cylinder, at least one valve, a crankshaft and a connecting rod between said crankshaft and said piston; first conduit means defining a first path for the flow of lubricant in said housing from and back to said source and for lubrication and cooling of said mobile components; second conduit means defining a second path for the flow of lubricant from and back to said source and for external cooling of said cylinder and at least one of said mobile components; and means for circulating the lubricant along said paths, including a tandem pump having a common inlet connected with said source and discrete outlets each arranged to deliver lubricant to one of said conduit means.

5. The engine of claim 1, further comprising discrete means monitoring at least one variable parameter of lubricant in each of said conduit means.

6. The engine of claim 1, wherein each of said conduit means includes means for maintaining the pressure of lubricant in the respective paths within predetermined ranges.

7. The engine of claim 6, wherein the range of pressures in said first path is a multiple of the range of pressures in said second path.

8. The engine of claim 7, wherein the pressure of lubricant in said first path while the engine is warm and is running at nominal speed is between 8 and 12 times the pressure of lubricant in said second path.

9. The engine of claim 1, wherein said first conduit means includes channels in said components and said housing and said second conduit means includes at least one tubular member.

10. The engine of claim 1, wherein at least one of said conduit means comprises a bore which delivers lubricant from said source to said circulating means.

11. The engine of claim 1, wherein said pumps include a casing affixed directly to said housing.

12. The engine of claim 1, wherein said circulating means further includes filter means for lubricant and pressure relief valve means in at least one of said conduit means.

13. The engine of claim 12, wherein said filter means is installed in said first path.

14. The engine of claim 1, wherein said first conduit means includes means for spraying lubricant against at least one of said mobile components.

15. The engine of claim 14, wherein said spraying means includes means for directing at least one spray of lubricant against said piston and the interior of said cylinder.

16. The engine of claim 15, wherein said spraying means is arranged to spray 40–60% of lubricant which is circulated along said first path.

17. An internal combustion engine comprising a housing including at least one cylinder; a source of lubricant in said housing; a plurality of mobile components in said housing including a piston in said cylinder, at least one valve, a crankshaft and connecting rod between said crankshaft and said piston; first conduit means defining a first path for the flow of lubricant in said housing from and back to said source and for lubrication and cooling of said mobile components; second conduit means defining a second path for the flow of lubricant from and back to said source and for external cooling of said cylinder and at least one of said mobile components; means for circulating the lubricant along said paths; and guide means for said valve, said guide means consisting at least in part of heat-conducting material and said first path having a portion adjacent said guide means so that the lubricant which is circulated in said first conduit means exchanges heat with said guide means.

18. The engine of claim 17, wherein said valve comprises a spring and said guide means includes an annular retainer for said spring.

19. An internal combustion engine comprising a housing including at least one cylinder; a source of lubricant in said housing; a plurality of mobile components in said housing including a piston in said cylinder, at least one valve, a crankshaft and a connecting rod between said crankshaft and said piston; first conduit means defining a first path for the flow of lubricant in said housing from and back to said source and for lubrication and cooling of said mobile components; second conduit means defining a second path for the flow of lubricant from and back to said source and for external cooling of said cylinder and at least one of said mobile components; means for circulating the lubricant along said paths; and heat exchanger means installed in at least one of said conduit means and arranged to withdraw heat from lubricant in the respective path before such lubricant reenters said source.

20. An internal combustion engine comprising a housing including at least one cylinder; a source of lubricant in said housing; a plurality of mobile components in said housing including a piston in said cylinder, at least one valve, a crankshaft and a connecting rod between said crankshaft and said piston; first conduit means defining a first path for the flow of lubricant in said housing from and back to said source and for lubrication and cooling of said mobile components; second conduit means defining a second path for the flow of lubricant from and back to said source and for components; and means for regulating the flow of lubricant in one of said paths, including a thermostatically controlled valve, a pressure relief valve and a distributor valve.

21. An internal combustion engine comprising a housing including at least one cylinder; a source of lubricant in said housing; a plurality of mobile components in said housing including a piston in said cylinder, at least one valve, a crankshaft and a connecting rod between said crankshaft and said piston; first conduit means defining a first path for the flow of lubricant in said housing from and back to said source and for lubrication and cooling of said mobile components; second conduit means defining a second path for the flow of lubricant from and back to said source and for external cooling of said cylinder and at least one of said mobile components, one of said conduit means defining three sections of the respective path; means for circulating the lubricant along said paths; a valve in the first of said sections; an atmospheric heat exchanger in the second of said sections; and a heater, such as a cabin heater, in the third of said sections.

22. The engine of claim 20, wherein said regulating means defines three discrete sections of said one path each of which is controlled to prevent or permit the flow of lubricant toward said source.

* * * * *